US010006212B2

(12) United States Patent
Chen

(10) Patent No.: US 10,006,212 B2
(45) Date of Patent: Jun. 26, 2018

(54) ASSEMBLED HOUSE

(71) Applicant: Sheng-Liang Chen, Taipei (TW)

(72) Inventor: Sheng-Liang Chen, Taipei (TW)

( * ) Notice: Subject to any disclaimer, the term of this patent is extended or adjusted under 35 U.S.C. 154(b) by 184 days.

(21) Appl. No.: 14/951,455

(22) Filed: Nov. 24, 2015

(65) Prior Publication Data

US 2017/0145708 A1 May 25, 2017

(51) Int. Cl.

| | |
|---|---|
| ***E04H 1/12*** | (2006.01) |
| ***E04B 1/348*** | (2006.01) |
| ***E04B 1/41*** | (2006.01) |
| ***E04B 2/56*** | (2006.01) |
| ***E04B 7/20*** | (2006.01) |
| ***E04H 1/00*** | (2006.01) |
| ***E04B 1/343*** | (2006.01) |
| *E04B 1/24* | (2006.01) |

(52) U.S. Cl.

CPC ..... *E04H 1/12* (2013.01); *E04B 1/34321* (2013.01); *E04B 1/34336* (2013.01); *E04B 1/34384* (2013.01); *E04B 7/20* (2013.01); *E04H 1/00* (2013.01); *E04H 1/005* (2013.01); *E04B 2001/2478* (2013.01)

(58) Field of Classification Search

CPC ... E04H 1/12; E04H 1/005; E04B 7/20; E04B 1/34321; E04B 1/34384; E04B 1/34336; E04B 2001/2478

USPC ..... 52/79.1, 261, 262, 272, 274, 282.2, 698, 52/831, 834, 835, 838, 839, 843, 845, 52/848, 79.5, 79.11, 79.12, 90.1, 143, 52/293.3, 294, 295, 296, 299, 641, 653.1; 403/170–172, 176, 217; 248/346.01

See application file for complete search history.

(56) References Cited

U.S. PATENT DOCUMENTS

| | | | | |
|---|---|---|---|---|
| 1,804,774 A * | 5/1931 | Hudson | C23G 3/00 | 52/236.3 |
| 2,010,874 A * | 8/1935 | Matheny | E04B 1/26 | 52/641 |
| 2,078,968 A * | 5/1937 | Patterson | E04B 1/24 | 52/210 |
| 2,078,969 A * | 5/1937 | Patterson | E02D 27/16 | 14/75 |
| 2,138,182 A * | 11/1938 | Lipthrott | A01M 1/245 | 43/124 |
| 2,163,286 A * | 6/1939 | Munro | E04B 1/644 | 52/250 |

(Continued)

*Primary Examiner* — Joshua J Michener
*Assistant Examiner* — Keith Minter
(74) *Attorney, Agent, or Firm* — WPAT, PC

(57) ABSTRACT

An assembled house has a house framework, a roof framework, wall panels and a roof panel. The house framework has multiple beams, columns, and connectors. The roof framework has multiple rafters. Each one of the connectors is mounted securely in the column, and has multiple screw sleeves mounted securely in a concrete body. Thus, the beam can be connected securely to the column by screws screwed into the screw sleeve of the connector. Welding is not required for assembling the house framework on the site of the assembled house, thereby effectively accelerating the assembling. In addition, the beams and the columns are connected without welding, which eliminates the problem that the welded portions may easily rust. Furthermore, the columns, rafters, and the beams are hollow tubes, which can effectively lower the weight of the whole assembled house.

16 Claims, 17 Drawing Sheets

(56) References Cited

U.S. PATENT DOCUMENTS 2,501,313 A * 3/1950 Carter ..... F16B 5/02 114/86
3,429,092 A * 2/1969 Hart ..... E04B 1/20 52/236.7
3,513,610 A * 5/1970 Devonport ..... B28B 23/00 52/283
3,593,477 A * 7/1971 Briggs ..... E04B 1/185 52/253
3,711,133 A * 1/1973 Werner ..... F16B 7/00 248/188.1
3,835,354 A * 9/1974 Torres-Pena ..... A47B 47/0041 108/187
4,011,697 A * 3/1977 Fedolfi ..... E04B 1/24 52/745.01
4,032,155 A * 6/1977 Thomas ..... A63F 9/06 273/156
4,082,470 A * 4/1978 Alberts ..... A47B 47/0016 403/172
4,167,838 A * 9/1979 Metheny ..... A01G 9/14 52/262
4,235,559 A * 11/1980 Rooklyn ..... F16B 12/30 403/171
4,546,530 A * 10/1985 Rizk ..... E04B 1/3483 29/430
4,630,550 A * 12/1986 Weitzman ..... A47B 13/06 108/155
4,899,497 A * 2/1990 Madl, Jr. ..... E04B 1/0007 52/126.6
4,910,932 A * 3/1990 Honigman ..... E04B 1/08 52/280
4,929,114 A * 5/1990 Young ..... E04B 1/5831 403/172
4,970,833 A * 11/1990 Porter ..... E04B 1/24 403/171
5,218,802 A * 6/1993 Yoshimura ..... E04B 1/215 52/253
5,289,665 A * 3/1994 Higgins ..... E04B 1/2403 211/191
5,481,842 A * 1/1996 Gautreau ..... E04B 2/76 403/231
5,577,353 A * 11/1996 Simpson ..... E04B 7/022 403/170
5,660,005 A * 8/1997 Tacoma ..... E04B 1/24 52/222
5,813,174 A * 9/1998 Waller ..... E04B 1/34315 109/78
5,826,379 A * 10/1998 Curry ..... E04B 1/3483 52/272
6,219,989 B1 * 4/2001 Tumura ..... E04B 1/2403 52/274
6,460,297 B1 * 10/2002 Bonds ..... E04C 2/384 52/234
6,519,900 B1 * 2/2003 Pierce ..... E04B 1/24 52/274
6,959,515 B1 * 11/2005 Beighton ..... E04B 1/3483 52/236.7
7,299,593 B1 * 11/2007 diGirolamo ..... E04B 2/58 52/241
7,607,273 B2 * 10/2009 Henderson ..... E04B 1/2403 403/313
8,671,642 B2 * 3/2014 Green ..... E04C 3/11 52/634
8,671,644 B2 * 3/2014 Huang ..... A47B 13/06 108/155
8,763,315 B2 * 7/2014 Hartman ..... E04B 1/3445 52/71
8,931,223 B2 * 1/2015 Speer ..... E04B 2/16 52/223.7
8,973,332 B2 * 3/2015 Lee ..... E04B 1/24 403/205
9,114,325 B1 * 8/2015 Sternhill ..... A63H 33/107
9,169,631 B2 * 10/2015 Tate ..... E02D 27/00
9,551,149 B1 * 1/2017 Scott ..... E04C 2/428
9,644,367 B2 * 5/2017 Kawano ..... E04B 1/48
9,689,163 B2 * 6/2017 Green ..... E04C 3/11
2001/0015047 A1 * 8/2001 Branson ..... A01K 1/00 52/745.01
2002/0095888 A1 * 7/2002 Winskye ..... E04B 1/24 52/234
2003/0019167 A1 * 1/2003 Baume ..... E04B 5/02 52/79.1
2003/0024173 A1 * 2/2003 Cohen ..... E04H 6/04 52/79.1
2003/0041549 A1 * 3/2003 Simmons ..... E04B 1/2403 52/655.1
2004/0049992 A1 * 3/2004 Seavy ..... E04B 2/7453 52/79.1
2004/0111983 A1 * 6/2004 Rozenberg ..... A01G 9/16 52/79.1
2004/0139683 A1 * 7/2004 Simmons ..... E04B 1/2403 52/719
2006/0156643 A1 * 7/2006 Lin ..... E04B 1/24 52/79.1
2007/0033882 A1 * 2/2007 Bessent ..... E04H 1/125 52/79.1
2007/0113488 A1 * 5/2007 Wilson ..... E04B 1/344 52/79.5
2007/0199252 A1 * 8/2007 Boros ..... E04B 1/24 52/79.1
2007/0209314 A1 * 9/2007 Vaughn ..... E02D 27/34 52/838
2007/0261356 A1 * 11/2007 Vaughn ..... E02D 27/34 52/655.1
2008/0178551 A1 * 7/2008 Porter ..... E04B 1/24 52/653.1
2008/0203262 A1 * 8/2008 Sparks ..... F16B 7/18 248/346.01
2009/0239441 A1 * 9/2009 Hu ..... A63H 33/10 446/123
2010/0018131 A1 * 1/2010 Green ..... E04B 1/24 52/79.5
2010/0101160 A1 * 4/2010 Bongiorno ..... E04C 5/02 52/167.1
2010/0126103 A1 * 5/2010 diGirolamo ..... E04B 2/58 52/655.1
2011/0000146 A1 * 1/2011 Takeda ..... A47C 29/003 52/79.1
2012/0102871 A1 * 5/2012 Randall ..... E04H 1/1205 52/653.1
2012/0301215 A1 * 11/2012 Huang ..... A47B 47/0016 403/176
2013/0192147 A1 * 8/2013 Schaffert ..... E04B 1/344 52/79.5
2013/0326968 A1 * 12/2013 Meyer ..... E04C 3/36 52/126.7
2014/0290154 A1 * 10/2014 Perko ..... E04H 9/145 52/126.5
2015/0176272 A1 * 6/2015 Takada ..... B21C 37/0803 52/831
2015/0267460 A1 * 9/2015 Header ..... E06B 1/524 52/204.5
2016/0076246 A1 * 3/2016 Romanenko ..... E04B 1/04 52/204.1
2016/0138258 A1 * 5/2016 Schaffert ..... E04B 1/3445 52/79.5
2017/0233995 A1 * 8/2017 Abernathy ..... F16B 7/182 52/845
2017/0233996 A1 * 8/2017 Abernathy ..... E04B 1/2403 52/698
2017/0314254 A1 * 11/2017 Houghton ..... E04B 1/1912

* cited by examiner

ASSEMBLED HOUSE

BACKGROUND OF THE INVENTION

1. Field of the Invention

The present invention relates to an assembled house, especially to an assembled house that can be assembled quickly and easily.

2. Description of the Prior Arts

Comparing with a traditional house that is constructed in reinforced concrete, an assembled house can be constructed quickly and has lower cost. Thus, the assembled houses are often used as temporary residences. A conventional assembled house has a house framework and multiple wall panels. The house framework is formed by welding multiple steel bars together. The wall panels are mounted between the steel bars to form walls, the floor, and the roof of the conventional assembled house.

However, the conventional assembled house has three shortcomings.

First, the welded steel bars of the conventional assembled house cannot be manufactured in the factory in advance, and must be welded on the site of the assembled house. Thus, the constructing of the assembled house on the site thereof must take much time.

Second, the welded portions on the steel bars easily rust.

Third, if the welding work is not done properly, the connecting strength between the beam and the column may be not strong enough.

Fourth, after the beam and the column are welded together, the beam and the column cannot be separated without causing any damage to both the beam and the column. Thus, it is hard to recycle and reuse the components of the conventional assembled house.

Fifth, although the conventional assembled house is reduced in weight compared with the traditional house that is constructed in reinforced concrete, the conventional assembled house is still too heavy to be transported directly.

To overcome the shortcomings, the present invention provides an assembled house to mitigate or obviate the aforementioned problems.

SUMMARY OF THE INVENTION

The main objective of the present invention is to provide an assembled house that can be assembled quickly and easily.

a house framework having multiple beams, each one of the beams being elongated and having at least three side walls and two end walls;

multiple columns, each one of the columns being an elongated and hollow square tube, and having at least four side walls; and multiple connectors mounted securely in the columns, and each one of the connectors having a concrete body; and multiple screw sleeves mounted securely in the concrete body, exposed on at least two surfaces of the concrete body, and each one of the screw sleeves having multiple inner threads formed in the screw sleeve;

an opening communicating with an exterior environment out of the concrete body; and wherein when the connector is connected to multiple ones of the beams, each one of at least one screw is mounted through one of the end walls of one of said beams and one of the at least four side walls of the column, and is screwed into one of the screw sleeves;

multiple wall panels mounted on the house framework;

a roof frame work; and at least one roof panel mounted on the roof frame work.

The beams are connected to the columns by screwing screws into the connectors mounted inside of the columns, such that welding is not needed when the house framework is assembled on the site of the assembled house, thereby effectively accelerating the assembling. In addition, the beams and the columns are connected without welding, which eliminates the problem that the welded portions may easily rust. Besides, the beams and columns are connected by screws, and the assembling of the screws does not rely on sophisticated techniques such as welding, thereby preventing the connecting strength from being too weak caused by insufficient proficiency of the worker. The screws connecting also enables the beams and the columns to separate almost without damage, and thus the beams and the columns can be recycled and reused. Furthermore, both the columns and the beams are hollow tubes, which can effectively lower the weight of the whole assembled house.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
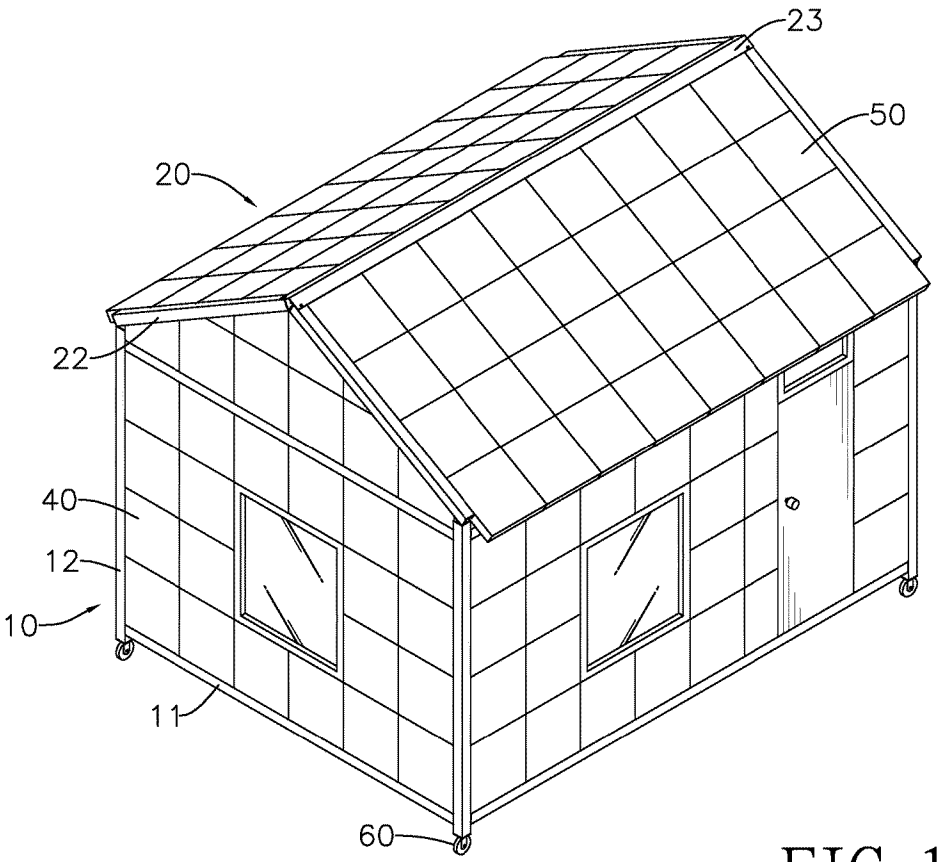
FIG. 1 is a perspective view of a first embodiment of an assembled house in accordance with the present invention.
Figure 2:
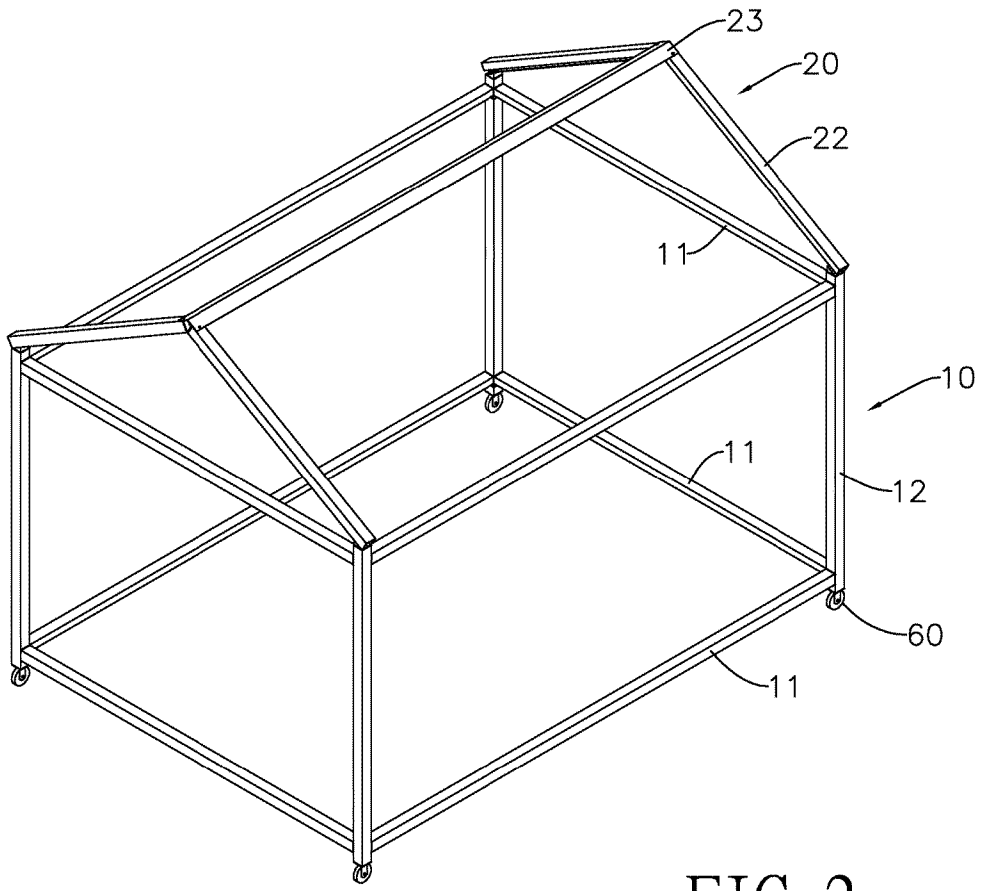
FIG. 2 is a perspective view of a house framework of the assembled house in FIG. 1.
Figure 3:
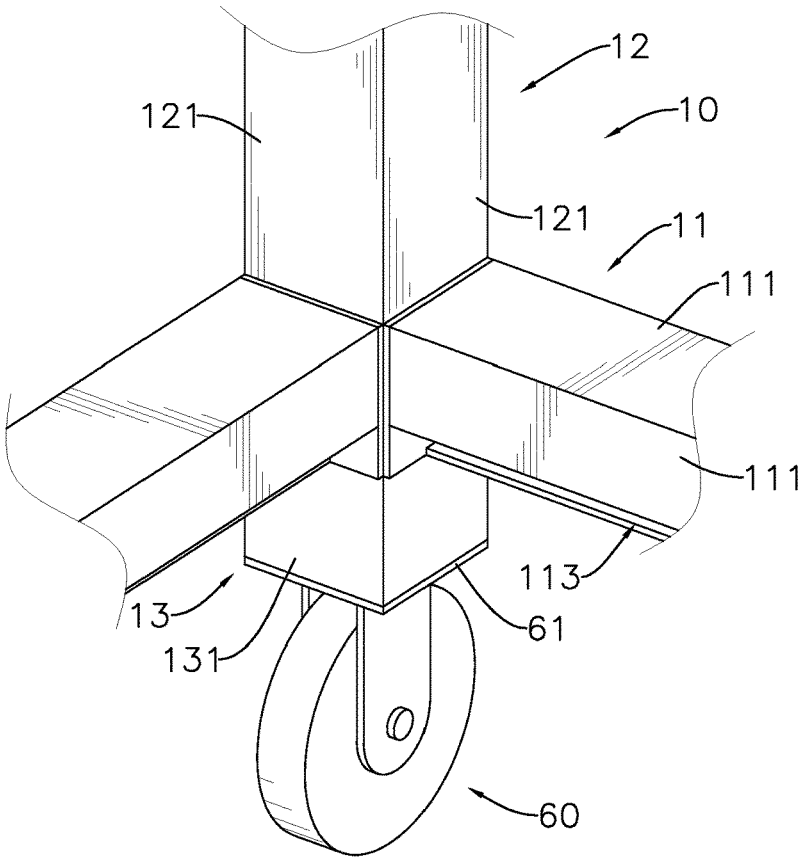
FIG. 3 is an enlarged perspective view of the house framework of the assembled house in FIG. 1, showing a lower connector.

With reference to FIGS. 1 and 2, an assembled house in accordance with the present invention comprises a house framework 10, a roof framework 20, a floor 30, multiple wall panels 40 and multiple roof panels 50.

A first embodiment of the present invention is a basic-type assembled house, which has a sloped roof.

The house framework 10 has eight beams 11 arranged into two rectangular loops, four columns 12 mounted between said two rectangular loops, and eight connectors 13.

With reference to FIGS. 3 to 6, each one of the beams 11 is a horizontally elongated and hollow square tube, and has four side walls 111, two end walls 112 and an elongated opening 113. The end panels 112 are connected to the four side walls 111. The elongated opening 113 is formed through one of the side walls 111 and extending to the two end walls 112.

Each one of the columns 12 is a vertically elongated and hollow square tube, and has four side walls 121. The column 12 has, but not limited to, two end openings 122.

The connectors 13 are mounted securely in the columns 12. Four of the eight connectors 13 are disposed near bottoms of the four columns 12 for respectively connecting four wheels 60. The other four connectors 13 are disposed near tops of the four columns 12 for respectively connecting the roof framework 20.

Each one of the connectors 13 has a concrete body 131, a reinforced frame 132, and multiple screw sleeves 133. The concrete body 131 is substantially a rectangular prism that has four side surfaces, a top surface and a bottom surface. The reinforced frame 132 is substantially a rectangular loop and is mounted in the concrete body 131. That is, the concrete body 131 is disposed on an inner side and an outer side of the reinforced frame 132. The reinforced frame 132 has multiple through holes (not shown in the figures) for liquid concrete to flow during cement grouting to form the connector 13. The screw sleeves 133 are mounted securely in the concrete body 131, are exposed on at least two of the four surfaces of the concrete body 131, and are connected to the reinforced frame 132. Each one of the screw sleeves 133 has multiple inner threads formed in the screw sleeve 133 and an opening communicating with an exterior environment out of the concrete body 131. The opening of the screw sleeves 133 is disposed on the outer side of the reinforced frame 132. In a preferred embodiment, the screw sleeves 133 are connected to an outer surface of the reinforced frame 132.

Figure 5:
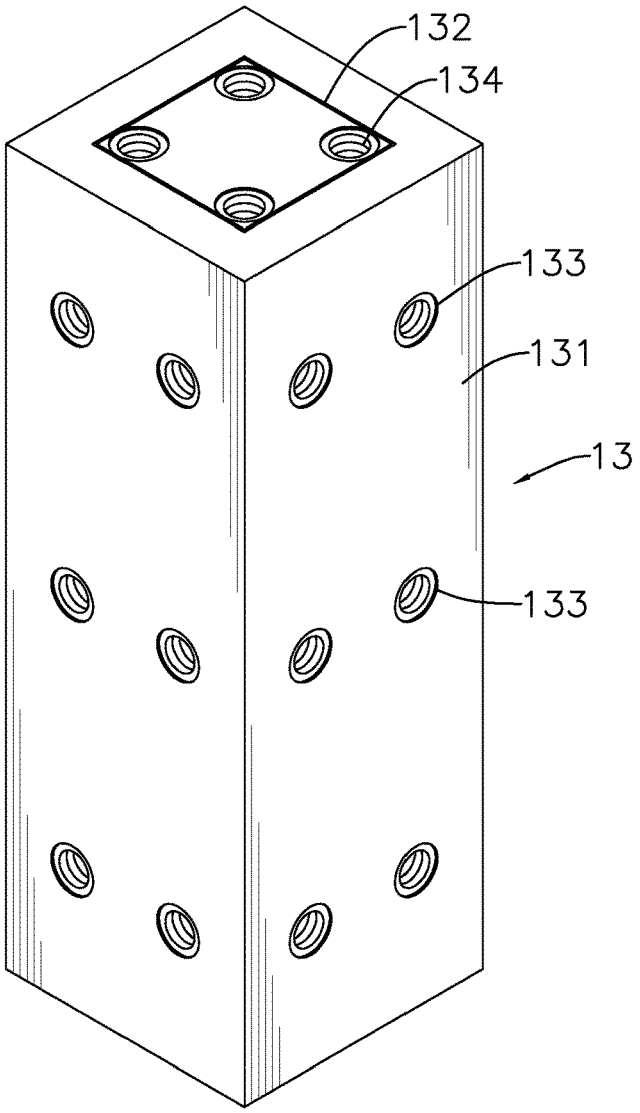
FIG. 5 is a perspective view of the connector of the assembled house in FIG. 1.
Figure 16:
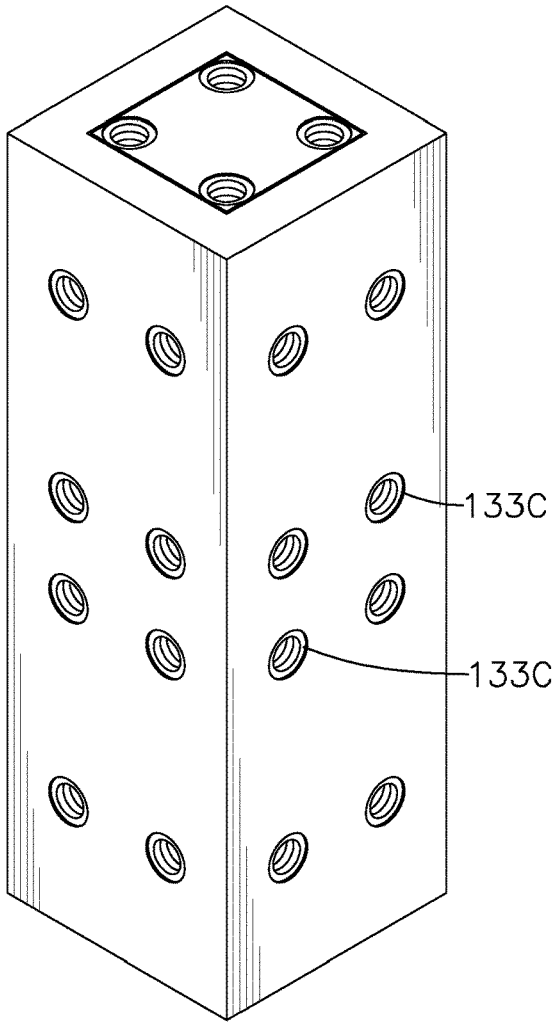
FIG. 16 is a perspective view of the connector of a fourth embodiment in accordance with the present invention.

In the preferred embodiment as shown in FIG. 5, each one of the side surfaces of the concrete body 131 has six screw sleeves 133. Two of said screw sleeves 133 are disposed in the middle of said side surface and are the major screw sleeves 133 for connecting the beams 11. The other four screw sleeves 133 are respectively disposed above and below the major two screw sleeves 133 for connecting auxiliary components. In another preferred embodiment as shown in FIG. 16, the amount of the major screw sleeves 133C may be added to four, thereby strengthening the connection to the beams 11. Because each one of the four side surfaces of the concrete body 131 has the screw sleeves 133, the connector 13 can be horizontally connected to four beams 11.

Figure 4:
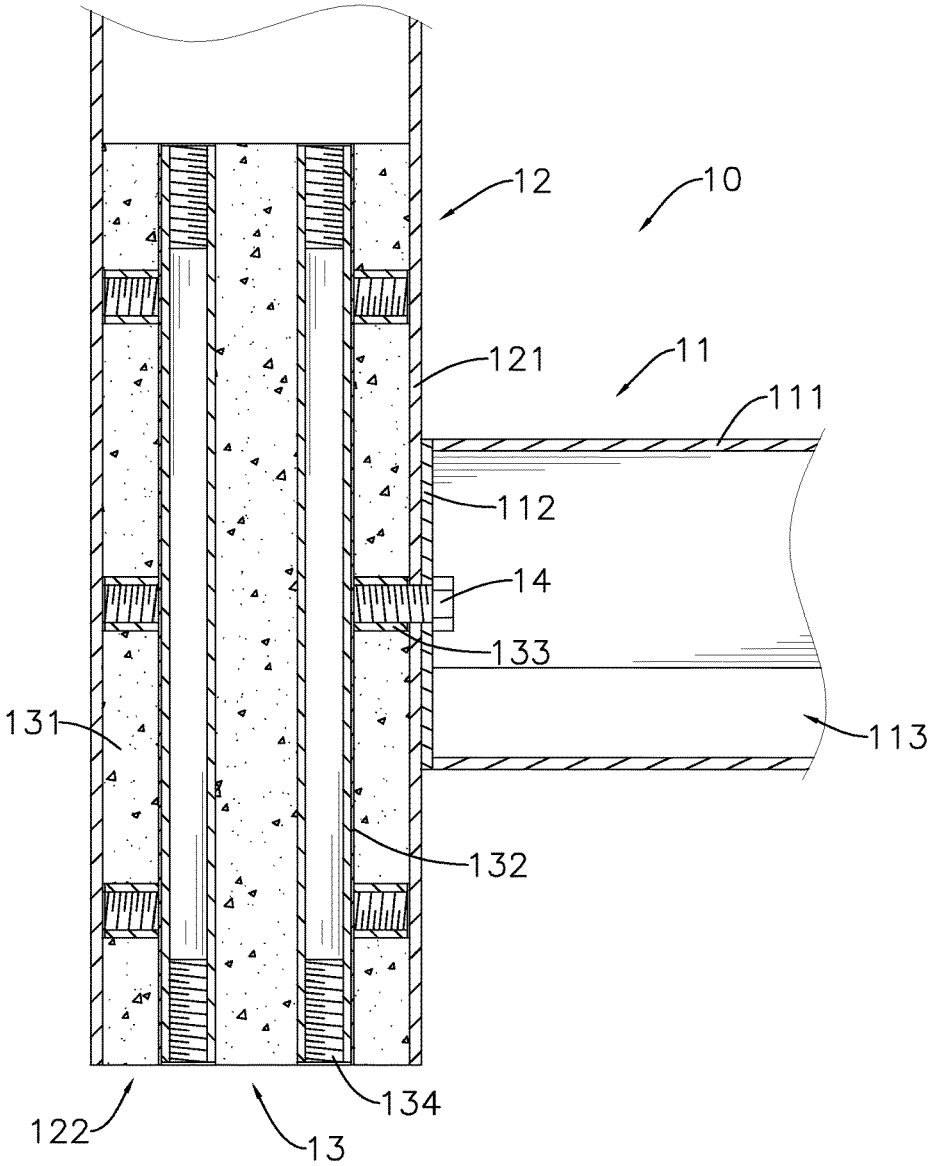
FIG. 4 is a side view in partial section of the house framework of the assembled house in FIG. 1, showing the lower connector.
Figure 6:
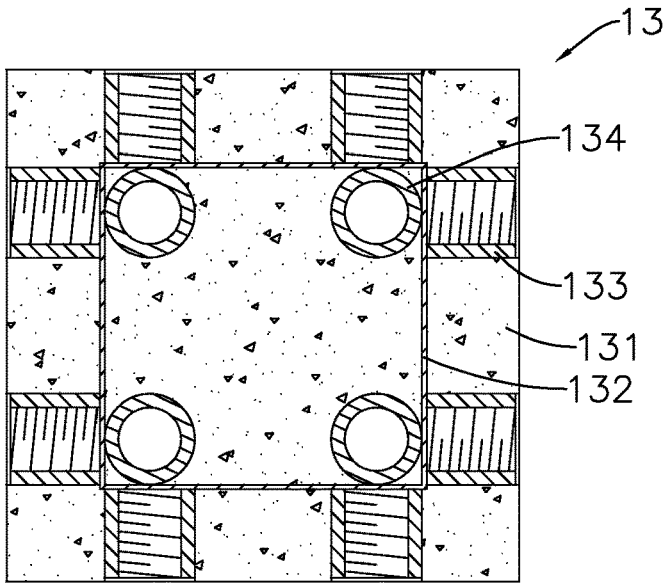
FIG. 6 is a top view in partial section of the connector of the assembled house in FIG. 1.

In the preferred embodiment as shown in FIGS. 4 to 6, the screw sleeves 133 that are exposed on the side surfaces of the concrete body 131 are welded to the reinforced frame 132. In addition, four upright screw sleeves 134 are elongated, extend to and are exposed on the top surface and the bottom surface of the concrete body 131, and each one of the upright screw sleeves 134 has two openings. Thus, the connector 13 can be connected to the roof framework, the wheels 60 or other components from a top or a bottom of the connector 13. In addition, the upright screw sleeves 134 are disposed inside the reinforced frame 132, and respectively abut four corners of the reinforced frame 132. Thus, the reinforced frame 132 can connect all the screw sleeves 133 and all the upright screw sleeves 134 in the same connector 13, thereby strengthening the connection between the screw sleeves 133, the upright screw sleeves 134, and the concrete body 131.

In another preferred embodiment, a top part and a bottom part of the reinforced frame are bent to be horizontal. Each one of the four screw sleeves, which are elongated and extending to and exposed on the top surface and the bottom surface of the concrete body with two openings, may be divided into two screw sleeves each with only one opening respectively. Said two screw sleeves, which are exposed on the top surface and the bottom surface of the concrete body, are not disposed inside the reinforced frame and are welded to the bent part of the reinforce frame.

Figure 17:
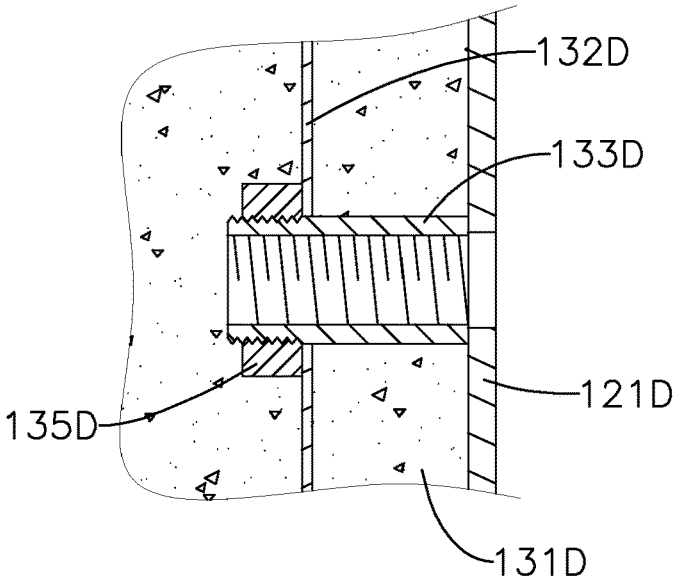
FIG. 17 is a side view in partial section of the connector of a fifth embodiment in accordance with the present invention.

The screw sleeves 133 may be connected to the reinforced frame 132 by other ways. In another preferred embodiment as shown in FIG. 17, the screw sleeves 133D are mounted through the reinforced frame 132D (but still abut the side wall 121D), and multiple nuts 135D are disposed inside the reinforced frame 132D, are screwed around the screw sleeves 133D, and abut inner surfaces of the reinforced frame 132D. In addition, the top part and the bottom part of the reinforced frame 132D are bent to be horizontal as mentioned above. Said two screw sleeves, which are exposed on the top surface and the bottom surface of the concrete body 131D, are connected to the bent part of the reinforce frame 132D by the nuts in the same way.

With reference to FIGS. 3, 4, 8 and 9, two beams 11 respectively abut two side walls 121 of the column 12, and are connected to the connector 13 inside the column 12. Particularly, the end wall 112 of each one of said beams 11 abuts the side wall 121 of the column 12, and two screws 14 are respectively mounted through the end wall 112 and the side wall 121, and are screwed into the corresponding screw sleeves 133 to securely connect said connector 13 and the beam 11. The worker may mount the screws 14 from the elongated opening 113 of the beams 11.

The wheel 60 is mounted on the bottom of the connector 13. Four screws 14 are respectively mounted through a top panel 61 of the wheel 60, and are screwed into the corresponding screw sleeves 133 to securely connect said connector 13 and the wheel 60.

Since the concrete body 131 of the connector 13 is elongated, there are sufficient abutment area between the concrete body 131 and an inner surface of the column 12, thereby providing firm connection between the connector 13 and the column 12.

Figure 7:
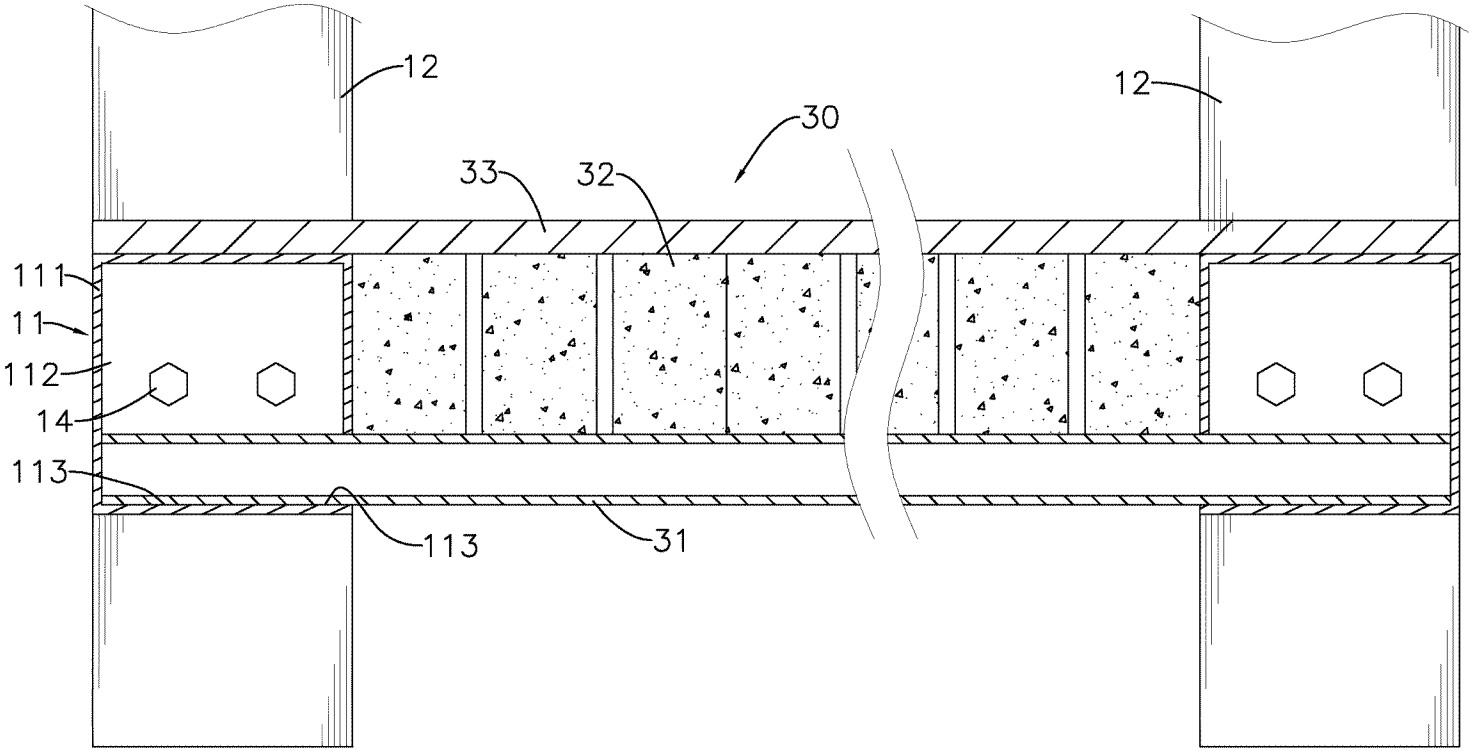
FIG. 7 is a front view in partial section of a floor of the assembled house in FIG. 1.
Figure 8:
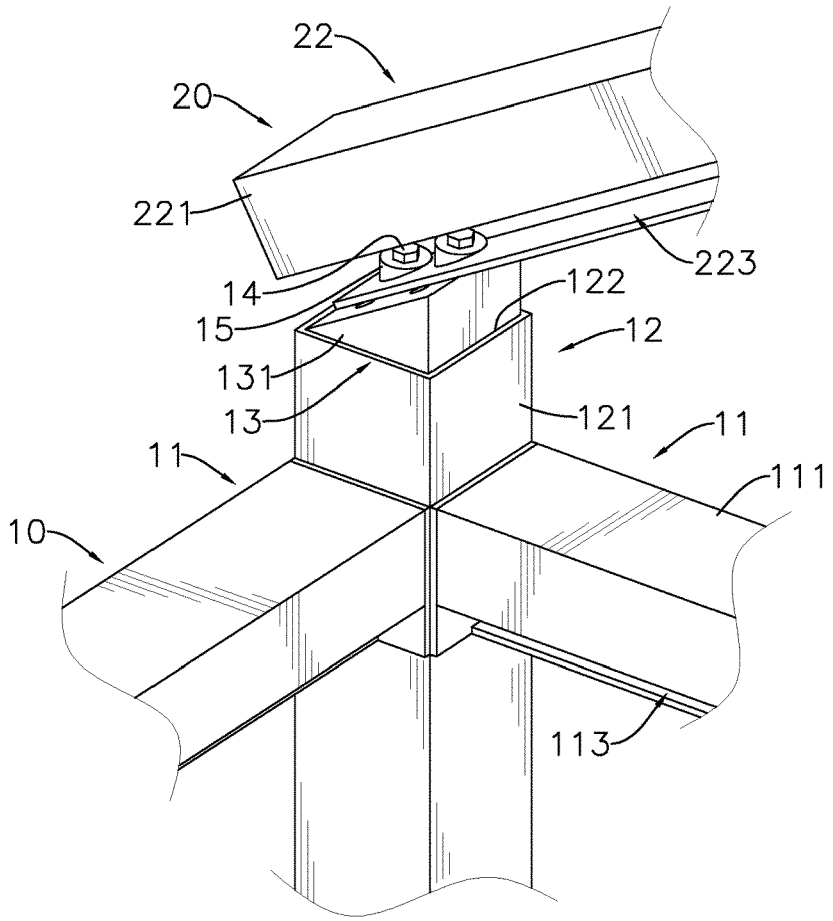
FIG. 8 is an enlarged perspective view of the house framework of the assembled house in FIG. 1, showing the upper connector.
Figure 9:
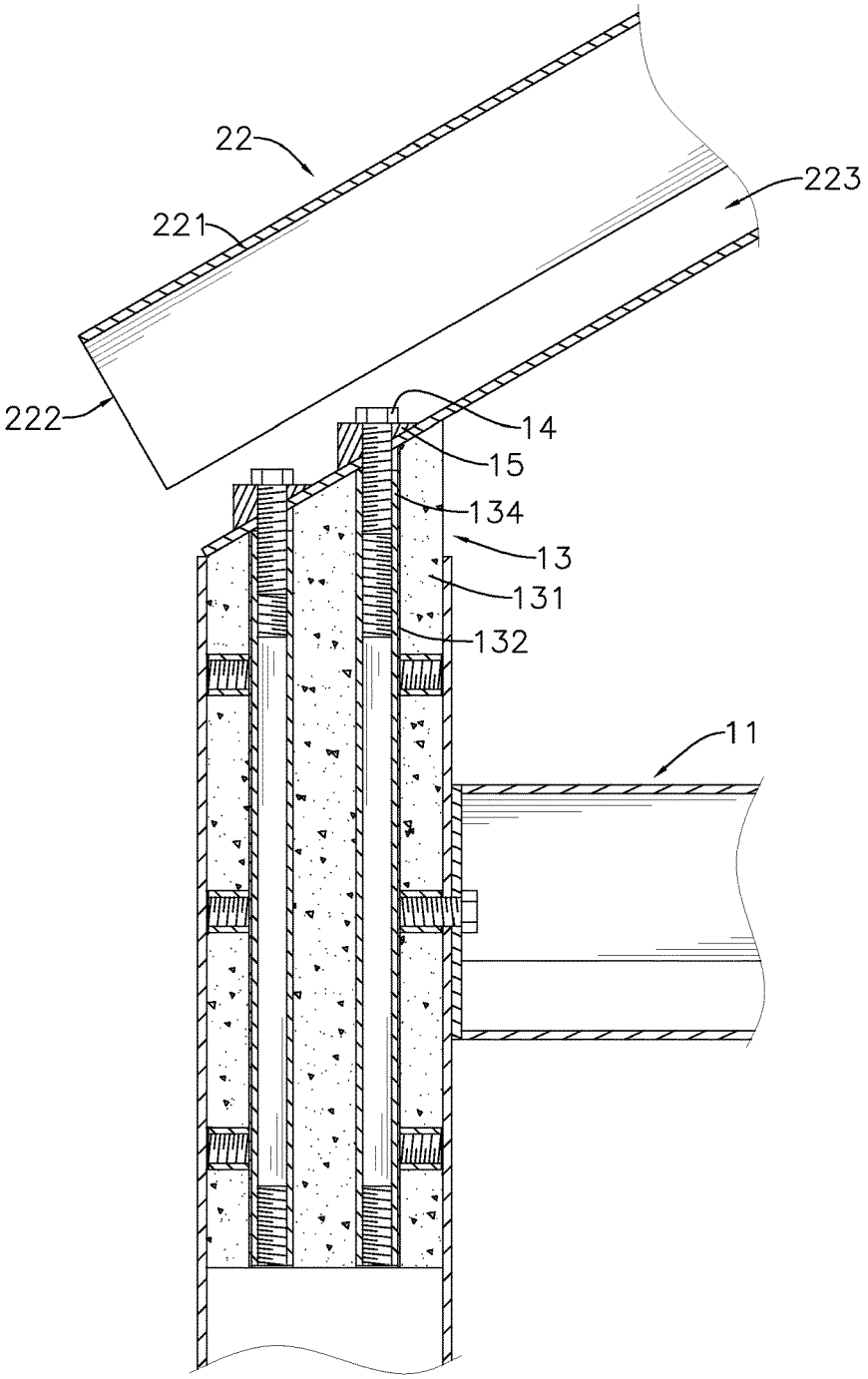
FIG. 9 is a side view in partial section of the house framework of the assembled house in FIG. 1, showing the upper connector.
Figure 10:
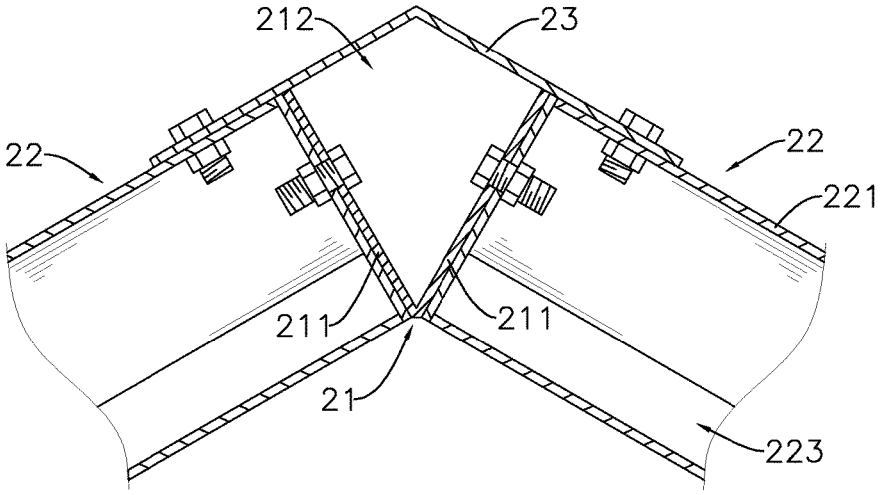
FIG. 10 is a side view in partial section of the house framework of the assembled house in FIG. 1, showing a roof framework.

With reference to FIG. 7, in each one of the beams 11, the elongated opening 113 is toward an inside of the house framework and adjacent to a bottom of the beam 11. The floor 30 is mounted on the house framework, and the floor 30 has multiple supporting tubes 31, multiple breathable bricks 32 and a floor panel 33. Two ends of each one of the supporting tubes 31 are respectively mounted in the elongated openings 113 of two opposite ones of the beams 11. The breathable bricks 32 are mounted on tops of the supporting tubes 31. The floor panel 33 is mounted on tops of the breathable bricks 32 and the beams 11.

With reference to FIGS. 2 and 8 to 10, the roof framework 20 has four rafters 22 and a ridge beam 21. The rafters 22 are basically the same as the column 12 of the house framework 10, but the rafters 22 may have an elongated opening 223. The elongated opening 223 is formed through one of multiple side walls 221 and extends to two end openings 222. The four rafters 22 are respectively and obliquely connected to the upper four connectors 13 of the house framework 10. The upper connectors 13 are the same as the connector 13 mentioned above, except that a top surface of the concrete body 131 of the connector 13 is an oblique surface, which is for one of the side walls 221 of the rafters 22 to abut. An oblique element 15 is disposed inside the rafters 22, and has an oblique bottom abutting an inner surface of the side wall 221 of the column 22 and a horizontal top. The screws 14 are vertically downward mounted through the oblique element 15 and the side wall 221 of the column 22, and are screwed into the screw sleeve 133 on the top of the upper connector 13 to connect the column 22 and the connector 13. The worker may mount the screws 14 from the elongated opening 223 or the end opening 222 of the column 22.

The ridge beam 21 is connected between the rafters 22. The ridge beam 21 is a horizontally elongated and hollow tube, and has two side walls 211 and a top opening 212. The two side walls 211 are connected to each other. The top opening 212 are formed between the two side walls 211 and extends to two ends of the ridge beam 21. Two of the rafters 22 are respectively connected to the two side walls 211 and are adjacent to one of the two ends of the ridge beam 21. The other two rafters 22 are respectively connected to the two side walls 211 and are adjacent to the other end of the ridge beam 21. The rafters 22 and the side walls 211 of the ridge beam 21 are connected to each other by screws and nuts. The worker may mount the screws and nuts from the top opening 212 of the ridge beam 21. A beam cover 23 is mounted on the rafters 22 by screws and nuts, and covers the top opening 212 of the ridge beam 21.

Figure 11:
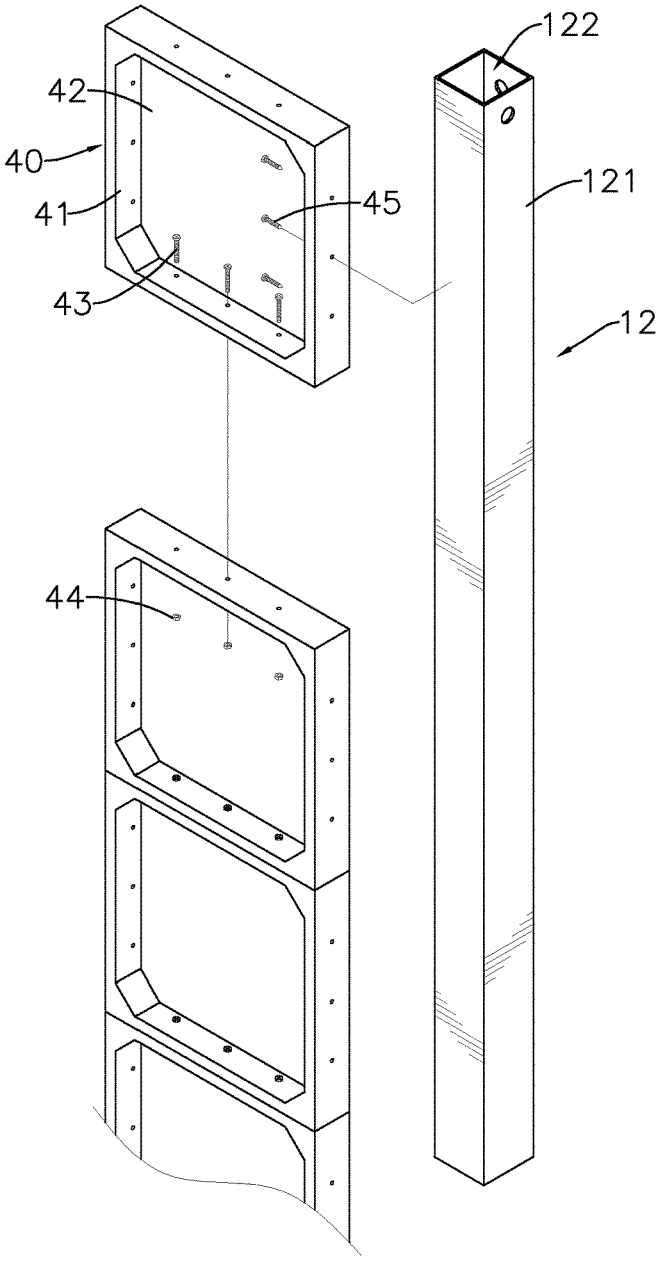
FIG. 11 is an exploded perspective view of the wall panels of the assembled house in FIG. 1.

With reference to FIGS. 1, 2 and 11, the wall panels 40 are erected, are mounted on both the house framework 10 and the roof framework 20, and are mounted between the columns 12, 22 and the beams 11. Each one of the wall panels 40 is rectangular, and has a wall frame 41 and a panel body 42. The wall frame 41 is a rectangular loop. The panel body 42 is connected to an outer side of the wall frame 41. Two adjacent ones of the wall panels 40 are connected to each other by screws 43 through the wall frames 41 and nuts 44. The wall panels 40 also can be connected to the beam 11 or the column 12, 22 by self-tapping screws 45 through the wall frames 41 and the side walls 111, 121, 221.

The roof panels 50 are mounted on a top of the roof framework 20. The roof panel 50 is preferably, but not limited to, the same as the wall panel 40 in structure.

Figure 12:
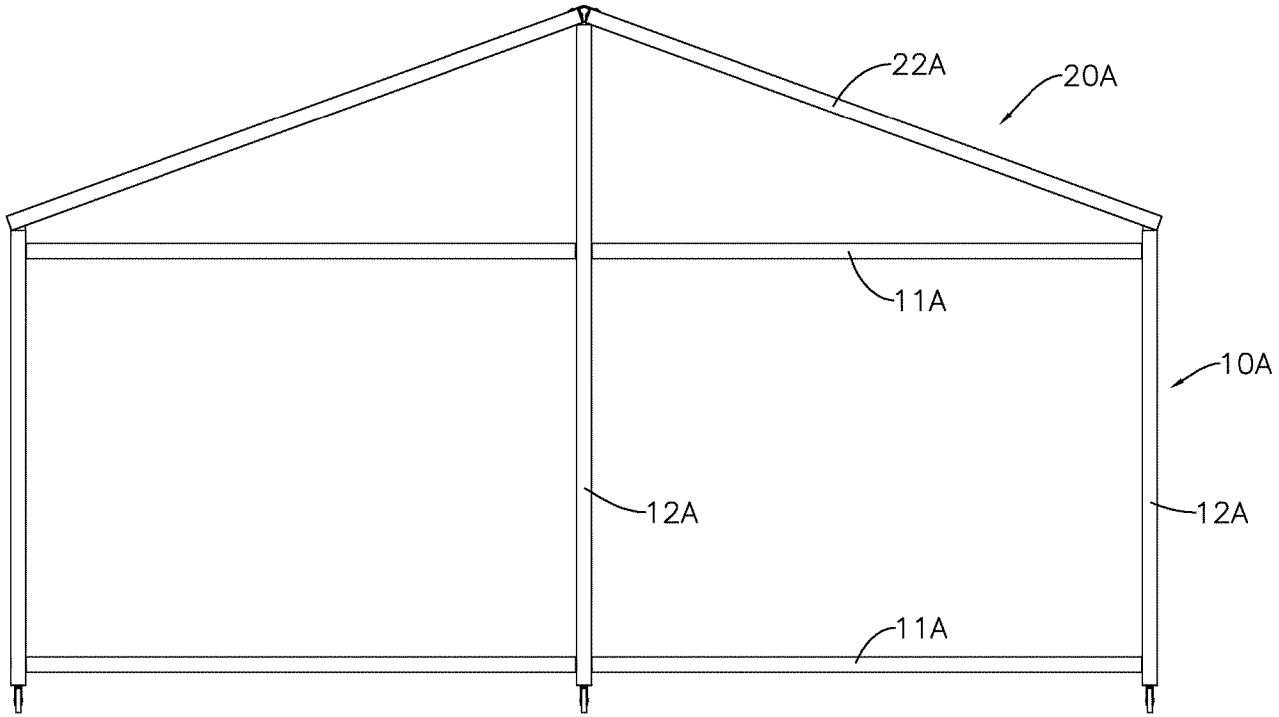
FIG. 12 is a front view of a second embodiment of the assembled house in accordance with the present invention.
Figure 13:
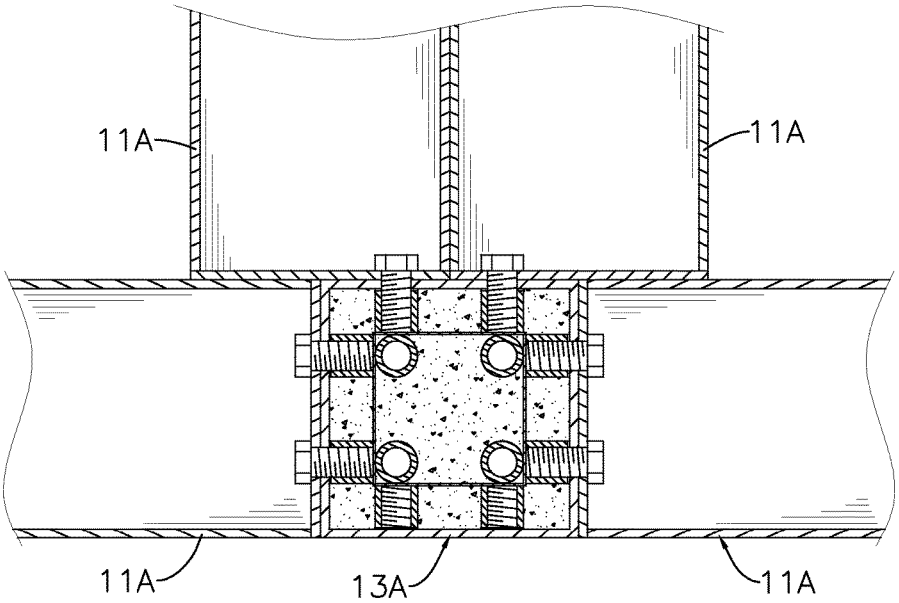
FIG. 13 is a top view in partial section of the connector of the assembled house in FIG. 12.
Figure 14:
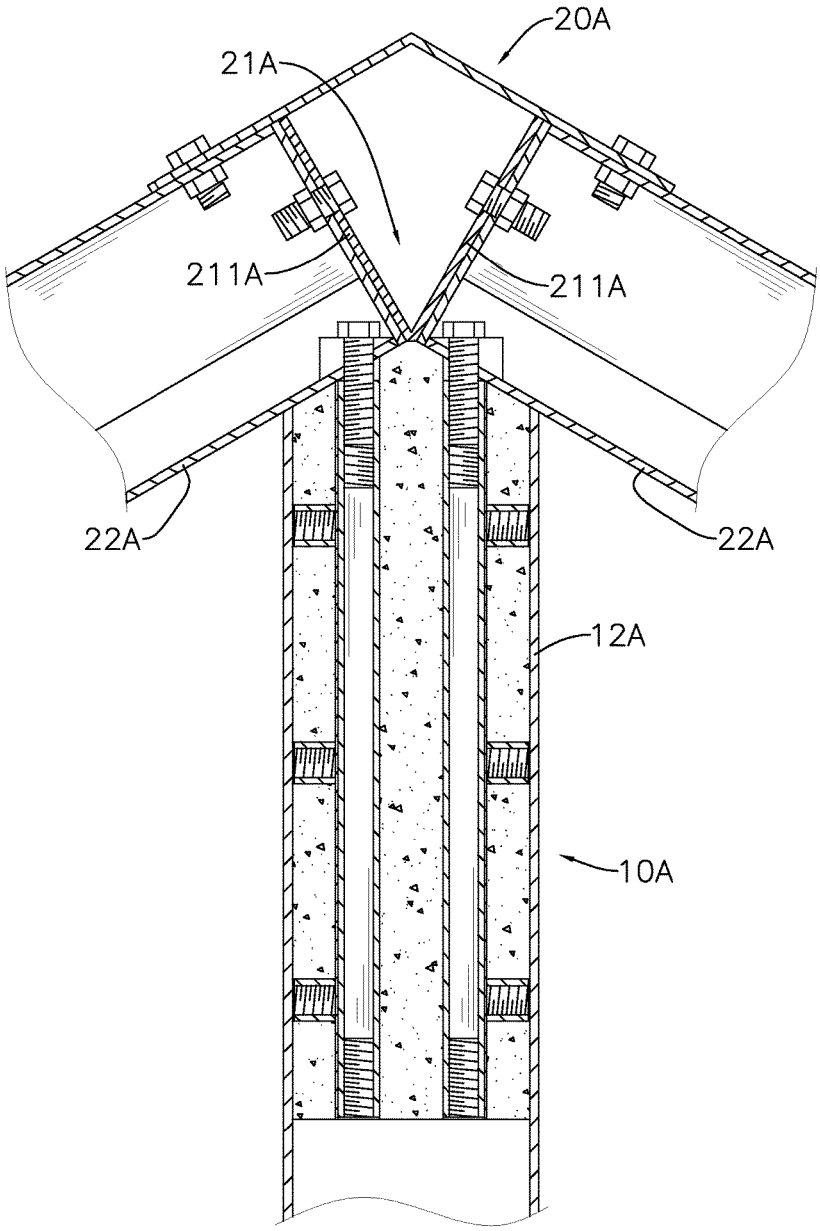
FIG. 14 is a front view in partial section of the upper connector of the assembled house in FIG. 12.

With reference to FIGS. 12 to 14, a second embodiment of the present invention is similar to the first embodiment in that the second embodiment combines two house frameworks of the first embodiment, but shares one roof framework of the first embodiment.

Part of the connectors 13A are each connected to four beams 11A respectively from three directions. In addition, with reference to FIG. 14, part of the columns 12A of the house framework 10A extend to the roof framework 20A. Each one of said columns 12A is connected to two rafters 22A that are respectively connected to the two side walls 211A of the ridge beam 21A by screws and nuts. Thus, the roof framework 20A is further supported.

Figure 15:
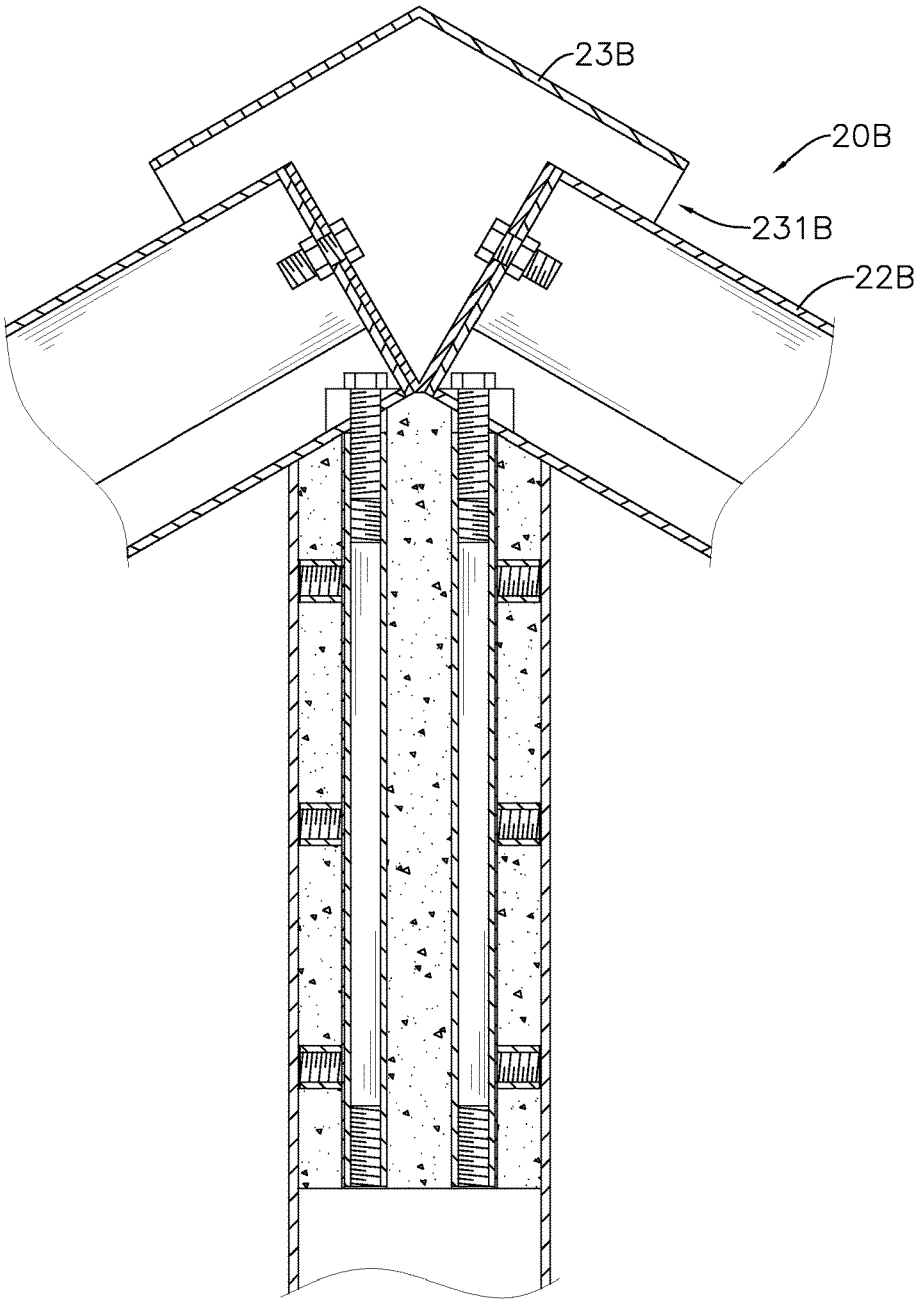
FIG. 15 is a front view in partial section of a third embodiment of the assembled house in accordance with the present invention.

With reference to FIG. 15, a third embodiment of the present invention is similar to the first embodiment, but in the roof framework 20B, there are holes 231B between the beam cover 23B and the rafters 22B for air ventilation.

To sum up, the beams 11, the columns 12, the rafters 22, and the ridge beams 21 are connected to each other mainly by screwing the screws into the connectors 13 mounted inside of the columns 12, such that welding is not required when the house framework is assembled on the site of the assembled house, thereby effectively accelerating the assembling. In addition, the beams 11, the columns 12, the rafters 22, and the ridge beams 21 are connected without welding, which eliminates the problem that the welded portions may easily rust. Furthermore, the beams 11, the columns 12, 22, and the ridge beams 21 are all hollow tubes, which can effectively lower the weight of the whole assembled house.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An assembled house comprising:

a house framework having multiple beams, each one of the beams being elongated and having at least three side walls and two end walls;

multiple columns, each one of the columns being an elongated and hollow square tube, and having at least four side walls; and multiple connectors mounted securely in the columns, and each one of the connectors having a concrete body;

a reinforced frame mounted in the concrete body and being a loop;

wherein the concrete body is disposed on an inner side and an outer side of the reinforced frame; and multiple screw sleeves mounted securely in the concrete body, exposed on at least two surfaces of the concrete body, connected to an outer surface of the reinforced frame, and each one of the screw sleeves having multiple inner threads formed in the screw sleeve;

an opening disposed on the outer side of the reinforced frame and communicating with an exterior environment out of the concrete body; and wherein when the connector is connected to multiple ones of the beams, each one of at least one screw is mounted through one of the end walls of one of said beams and one of the at least four side walls of the column, and is screwed into one of the screw sleeves;

multiple wall panels mounted on the house framework;

a roof frame work; and at least one roof panel mounted on the roof frame work.

2. The assembled house as claimed in claim 1, wherein in each one of the connectors, the concrete body has six surfaces, and the screw sleeves are exposed on all the six surfaces of the concrete body.

3. The assembled house as claimed in claim 1, wherein in each one of the connectors, part of the screw sleeves are welded to the reinforced frame.

4. The assembled house as claimed in claim 1, wherein in each one of the connectors, part of the screw sleeves are mounted through the reinforced frame;

multiple nuts are disposed inside the reinforced frame, are screwed around the screw sleeves, and abut inner surfaces of the reinforced frame.

5. The assembled house as claimed in claim 1, wherein in each one of the connectors, the reinforced frame is rectangular;

four upright screw sleeves are elongated, extend to and are exposed on a top surface and a bottom surface of the concrete body, are disposed inside the reinforced frame, and respectively abut four corners of the reinforced frame; and each one of said four upright screw sleeves has two openings.

6. The assembled house as claimed in claim 1, wherein in each one of the connectors, the reinforced frame is a rectangular loop but a top part and a bottom part of the reinforced frame are bent to be horizontal;

four of the screw sleeves exposed on a top surface of the concrete body are connected to the bent top part of the reinforced frame; and four of the screw sleeves exposed on a bottom surface of the concrete body are connected to the bent bottom part of the reinforced frame.

7. The assembled house as claimed in claim 1, wherein each one of the beams further has an elongated opening formed through one of the at least three side walls of said beam and extending to the two end walls.

8. The assembled house as claimed in claim 7, wherein in each one of the beams, the elongated opening is toward an inside of the house framework, and the assembled house further has a floor mounted on the house framework, and the floor has multiple supporting tubes, and each one of the supporting tubes having two ends respectively mounted in the elongated openings of two opposite ones of the beams; and a floor panel mounted on the supporting tubes.

9. The assembled house as claimed in claim 7, wherein in each one of the beams, the elongated opening is toward an inside of the house framework, and the assembled house further has a floor mounted on the house framework, and the floor has multiple supporting tubes, and each one of the supporting tubes having two ends respectively mounted in the elongated openings of two opposite ones of the beams;

multiple breathable bricks mounted on the supporting tubes; and a floor panel mounted on the breathable bricks and the beams.

10. The assembled house as claimed in claim 1, wherein the roof frame work is a sloped roof, and has multiple rafters obliquely connected to a top of the house framework, each one of the rafters being an elongated and hollow square tube, and having at least four side walls;

a ridge beam connected between the rafters;

a top surface of the concrete body of each one of the connectors, which are in the house framework and are for connecting to one of the rafters, is oblique, and abuts one of the at least four side walls of said rafter.

11. The assembled house as claimed in claim 10, wherein the ridge beam is an elongated and hollow tube, and has two side walls connected to each other, and respectively connected to the rafters by screws and nuts; and a top opening formed between the two side walls of the ridge beam and extending to two ends of the ridge beam.

12. The assembled house as claimed in claim 10, wherein part of the columns of the house framework extend to the roof framework, and each one of said columns is connected to two of the rafters that are connected to the two side walls of the ridge beam by screws and nuts.

13. The assembled house as claimed in claim 1, wherein part of the connectors are disposed near bottoms of the columns;

the assembled house further has multiple wheels mounted on bottom surfaces of said connectors that are disposed near the bottoms of the columns.

14. The assembled house as claimed in claim 1, wherein the wall panels are mounted between the columns and the beams; and a part of the wall panels are connected to the columns by screws, another part of the wall panels are connected to the beams by screws, and the remaining wall panels are connected to each other by screws.

15. The assembled house as claimed in claim 14, wherein the wall panel has a wall frame being a rectangular loop for screws to mount through; and a panel body connected to an outer side of the wall frame.

16. The assembled house as claimed in claim 1, wherein the beams of the house framework are hollow square tubes.

* * * * *